United States Patent [19]

Welcomer

[11] 4,226,163

[45] Oct. 7, 1980

[54] ILLUMINATED DRUMSTICKS

[76] Inventor: James D. Welcomer, 4979 Hamilton Dr., Paxton Hollow Estates, Box 106, Harrisburg, Pa. 17111

[21] Appl. No.: 15,817

[22] Filed: Feb. 27, 1979

Related U.S. Application Data

[63] Continuation-in-part of Ser. No. 789,628, Apr. 21, 1977, abandoned.

[51] Int. Cl.[3] ..... G10D 13/00

[52] U.S. Cl. ..... 84/422 S; 362/102; 362/800

[58] Field of Search ..... 84/422 S, 477 B; 362/102, 800

[56] References Cited

U.S. PATENT DOCUMENTS

| | | | |
|---|---|---|---|
| 2,225,151 | 12/1940 | Borba | 84/477 BX |
| 2,242,981 | 5/1941 | Pederson | 84/477 BX |
| 2,601,554 | 6/1952 | Peters | 84/477 BX |
| 3,737,647 | 6/1973 | Gomi | 362/800 X |
| 4,106,079 | 8/1978 | Drury | 362/102 X |

*Primary Examiner*—Lawrence R. Franklin
*Attorney, Agent, or Firm*—Brian L. Ribando

[57] ABSTRACT

A drumstick comprises a tip, a shank and a cap. The tip includes a light emitting diode and electrical leads connect the diode to a power source housed in a cavity formed between the shank and the cap. Threading the cap onto the shank effects a completed circuit including the power source and the diode. The motion of the lit stick tip enhances the rhythmic feelings contributed by the drummer to a musical group.

4 Claims, 4 Drawing Figures

ILLUMINATED DRUMSTICKS

This present application is a continuation-in-part of U.S. patent application Ser. No. 789,628, filed Apr. 21, 1977, now abandoned.

BACKGROUND OF THE INVENTION

The invention relates to a drumstick having a solid illuminated tip.

A drummer and the drumbeat which a drummer provides to a musical group is indispensible to that group. The drumbeat becomes the basic beat of the music that emanates from the group. The rhythm of the drum may at times stand alone in a musical composition, but a composition is seldom without the rhythmic accompaniment of a drum. The main contribution and his playing to music are aural. However, the contribution is also visual. The flash of the cycling drumsticks and the rhythmic waving of the drummer's hands, arms and whole body are part of the drummer's presence. However, until the present invention, drumsticks have been designed to contribute only to the sound which they produce, but not to the sight.

SUMMARY OF THE INVENTION

The drumstick of the present invention includes an illuminated impact resistant tip. The tip is connected to the drumstick shaft, and a cap is located at that end of the shaft which is opposite to the tip. The cap is threadably attached to the shaft and tightening the cap thereon completes an electric circuit including a light emitting diode, batteries, and electrical leads. The circuit may also include a strobe circuit which flashes the diode on and off in a predetermined sequence. It will be appreciated that the visual display of the lighted drumstick tip, set into motion by the drummer, will contribute appreciably to the visual appearance of the drummer's rhythm.

DESCRIPTION OF THE PREFERRED EMBODIMENT

Figures 1, 2, 3, 4:
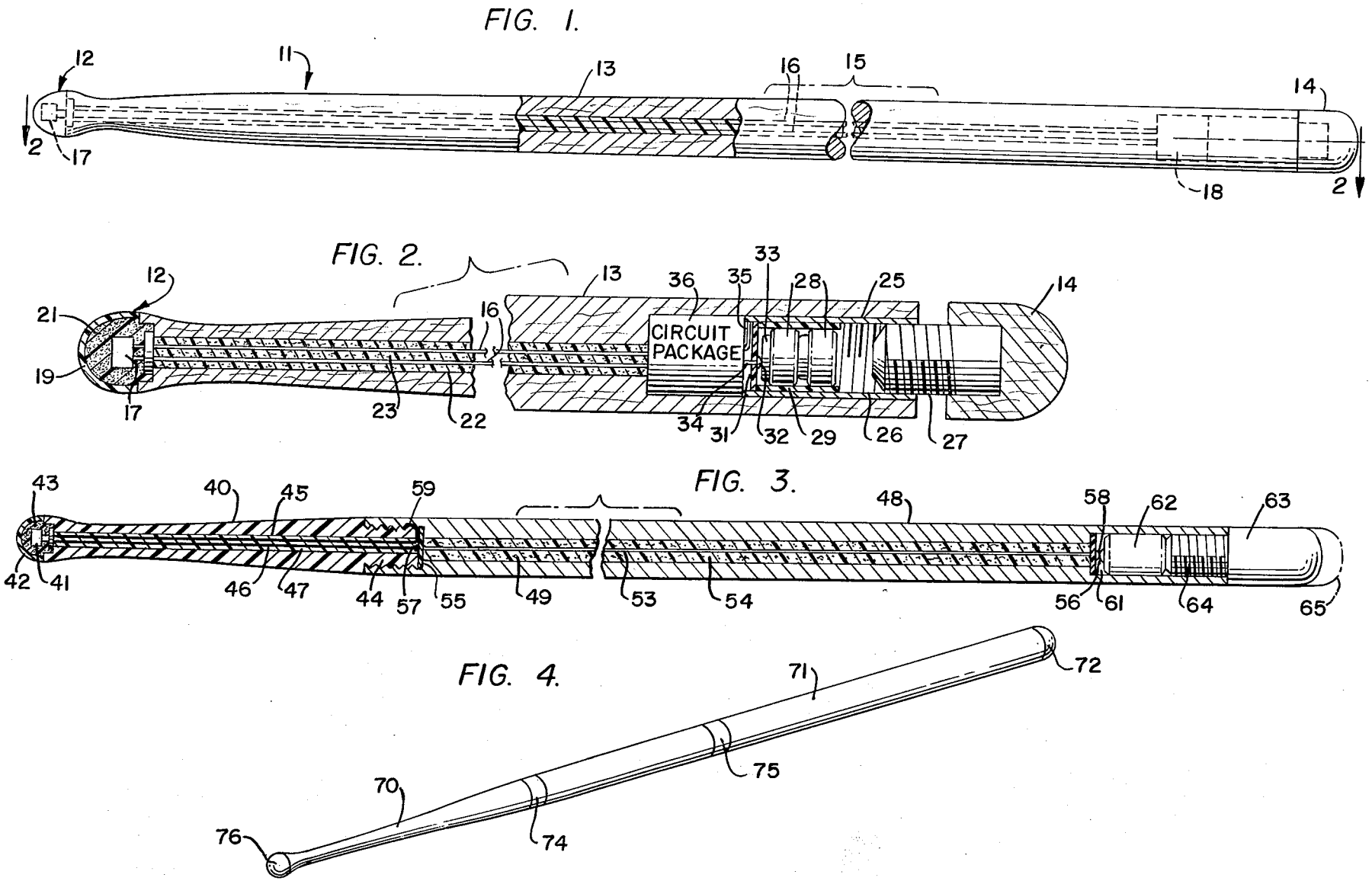
FIG. 1 is a side view of a drumstick according to the invention.
FIG. 2 is a sectional view taken along line 22 of FIG. 1, the view being broken to eliminate a portion of the central shank of the drumstick.
FIG. 3 is a sectional view of an alternative embodiment of a drumstick having an illuminated tip.
FIG. 4 is a perspective view of a drumstick having illuminatable bands along the length of the stick.

Beginning with FIG. 1, there is shown generally a drumstick 11 comprising a tip 12, a shank 13 and a cap 14. The shank 13 is shown broken at 15 to reveal a pair of conductors 16. The conductors 16 electrically connect a source of light 17 which is located at the drumstick tip 12 to a power source, shown diagramatically at 18.

Turning now to FIG. 2, the various components of the drumstick 11 may be seen with greater particularity. The tip 12 comprises an impact resistant clear lens 19 which may be formed of epoxy and which overlies a light source 17. In the preferred embodiment, a light emitting diode is used as the light source 17. The light emitting diode is a crystal which efficiently converts 99% of electrical energy applied thereto to light energy. The light emitting diode further possesses high structural integrity, is a solid device, and is capable of withstanding the shock and G force experienced by a drumstick tip.

The space between the light source 17 and the lens 19 is filled with a clear potting compound 21, such as a clear epoxy. It will be appreciated that since the light emitting diode is a solid void free device, the resulting tip 12 comprising the lens 19, the light source 17, and the potting compound 21 will likewise be solid and void free. The lens 19, the light source 17 and the potting 21 are affixed to the end of the stick shank 13. The shank 13 may be of wood, as shown, and in the alternative, materials such as metal, fiberglass, nylon, plexiglass and the like may be used. The shank 13 includes a central bore 22 through which pass the electrical leads 16. A plotting compound 23 fills the bore and prevents relative motion and rattling of the leads 16 therein.

The end of the shank which is opposite to the tip 12 includes a cavity 25. Lining the cavity is a threaded sleeve 26 of metal which is adapted to receive a threaded metallic plug 27. The plug 27 is carried by the cap 14. A pair of batteries 28 are located within the threaded sleeve 26 but are spaced therefrom by an electrically insulating sleeve 29. An insulating washer 31 is located ahead of the forwardmost of the batteries 28. A conductive rivet 32 of the washer 31 is adapted to connect a first circuit lead 34 to the central terminal 33 of the battery. A second circuit lead 35 is connected to the metallic sleeve 26. A circuit package 36 is located ahead of the insulating washer 31. The circuit package 36 may include a strobe circuit, or a motion sensing switch, or the like. The circuit package 36 couples the electrical leads 16 to the circuit leads 34 and 35.

The interrelationship between the various components of the drumstick 11 and the method of use should be apparent to those skilled in the art. By rotating the cap 14 and advancing the threaded plug 27 into the sleeve 26, the batteries 28 will be connected and urged into contact with the conductive rivet 32. Power from the batteries will be supplied to the light source 17 when the circuit package is in a conductive state. If the circuit package is a strobing circuit, light source 17 will be caused to blink on and off. If the circuit package includes a motion sensing device, light 17 will be caused to blink on and off in accordance with the motion of the drumstick 11. By rotating the cap 14 to withdraw the plug 27 from the threaded sleeve 26, a space will be created between the plug 27 and the rivet 32 which will be too large to be spanned by the batteries 28. When this occurs, the power will be disconnected from the light source 17. Optionally, a spring, not shown, could be used to bias the batteries out of contact with one another or with the rivet 32. The spring could be conductive or not, depending on its method of use.

Turning now to FIG. 3, an alternative embodiment of an illuminated drumstick is shown. It will be seen that an elongated tip 40 includes a light source 41 such as a light emitting diode, a clear lens 42, and a clear potting material 43 therebetween. The tip 40 may be fabricated from nylon, Delrin, Lexan, Figerglass or other suitable material and is formed with a threaded portion 44 and an axial bore 45. The bore 45 contains two leads 46 which protrude therefrom, and is filled with a potting compound 47. The threaded portion 44 mates with a threaded socket on one end of a drumstick shaft 48. The shaft is made of conductive material, such as metal, and includes a bore 49. The bore contains a single insulated conductor 53 and a quantity of potting compound 54. The bore is closed at both of its ends by insulating washers 55 and 56 which include conductive rivets 57 and 58 which extend therethrough. The rivet 57 contacts one of the leads 46 connected to the light source 41. The other lead 46 includes an extended lead 59 which wraps over the threaded portion 44 of tip 40. The lead 59 contacts the metal shaft 48 when the tip 40 is connected therewith.

The end of the shaft 48 which is opposite that end which mates with the tip 40 is formed with a cavity 61. This cavity receives a battery 62 and is threaded to receive a cap 63. The cap 63 includes a conductive threaded stub 64. The battery, when cap 63 is fully threaded into cavity 61, contacts rivet 58 and conductive threaded stub 64, and power is supplied to the light source 41. Partially withdrawing the cap 63 to the position 65 results in breaking the circuit and in turning off the light source 41. While this embodiment is shown without a circuit package, it will be appreciated by those skilled in the art that such a package could be included in the device without departing from the scope of the invention.

Turning now to FIG. 4, a drumstick is shown which comprises a tip 70, a shaft 71 and a cap 72. The shaft 71 includes two bands 74 and 75. The bands are transparent and house additional light sources (not shown). Means are provided in the drumstick for powering the light sources and for selectively connecting the means for powering to the light source. The tip 70 includes an end 76, which may be transparent and which may house an additional light source. The light sources may be operated together, or separately, as desired, and circuit such as a strobe, etc., may be provided for one or all of the light emitting regions.

Having thus described the invention, various departures and modifications will occur to those skilled in the art. For example, the light source, the lens thereover, or the potting therebetween may be chosen to give off a colored rather than a white light. Using the embodiments shown in FIG. 3, a drumstick set could include a pair of drumstick shanks with caps, and an assortment of pairs of tips. Each pair of tips would include illumination means in differing colors. One of the tip pairs could also be without illumination means where no light effect is desired. Of course, the embodiment shown in FIG. 2 could be modified wherein a drumstick shank and tip of similar material could include a threaded joint for removing the tip and replacing same with another having a different colored light source, or no light source at all. The mechanics of an electrical coupling whereby the two conductors within the shank could be connected with the conductors in the tip would be realizable by one skilled in the art. Also, light sources such as light emitting diodes may be combined in any type of percussive instrument striking means such as bass drum mallets, xylophone mallets, glockenspeil mallets and the like.

These and other departures from the description of the preferred embodiment are intended to be within the scope of my invention as defined in the appended claims.

I claim:

1. In a slender striking device having an elongated shank for use with a percussion instrument the elongated shank having a circumference which is small relative to its length throughout its length, the combination comprising:

an impact resistant tip means for striking said percussion instrument, said tip means comprising an epoxy lens and continuing the slender striking device, said tip means having a circumference which is substantially equal to the circumference of the elongated shank, light emitting diode means within said tip for illuminating said tip, protection means for said light emitting diode, said protection means comprising a clear epoxy potting compound filling a space between said light emitting diode and said lens, said lens, potting compound, and light emitting diode comprising a solid tip which is free of voids allowing said striking device to be used as a drumstick for repeatedly striking a percussion instrument, a power supply for said light emitting diode, a bore in said shank and conductive means in said bore for coupling said power supply to said light emitting diode, and means for selectively connecting said power supply to said light emitting diode.

2. The combination of claim 1 further comprising:

a cap, and means in said bore for receiving said cap, wherein said cap comprises the means for selectively connecting the power supply to the light emitting diode and said bore is enlarged to receive said power supply.

3. The combination of claim 1 further comprising:

a threaded portion on said tip and on said shank, whereby said tip is removable from said shank.

4. The combination of claim 1 further comprising:

a strobe circuit, said strobe circuit comprising circuit means for altering the operation of the light emitting diode.

* * * * *